US008182305B2

(12) United States Patent
Yoshizawa et al.

(10) Patent No.: US 8,182,305 B2
(45) Date of Patent: May 22, 2012

(54) METHOD FOR MANUFACTURING HIGH PRESSURE DISCHARGE LAMP

(75) Inventors: Toshio Yoshizawa, Gyoda (JP); Katsuhiro Okabe, Gyoda (JP); Makoto Ohkahara, Gyoda (JP); Nobuo Fukuda, Gyoda (JP); Shigeharu Sato, Gyoda (JP); Shinichi Takemasa, Gyoda (JP)

(73) Assignee: Iwasaki Electric Co., Ltd., Chuo-ku, Tokyo (JP)

( * ) Notice: Subject to any disclaimer, the term of this patent is extended or adjusted under 35 U.S.C. 154(b) by 0 days.

(21) Appl. No.: 13/002,993

(22) PCT Filed: Jun. 9, 2009

(86) PCT No.: PCT/JP2009/060495

§ 371 (c)(1), (2), (4) Date: Jan. 7, 2011

(87) PCT Pub. No.: WO2010/007844

PCT Pub. Date: Jan. 21, 2010

(65) Prior Publication Data

US 2011/0117805 A1 May 19, 2011

(30) Foreign Application Priority Data

Jul. 14, 2008 (JP) ..... 2008-182341

(51) Int. Cl.
*H01J 9/24* (2006.01)

(52) U.S. Cl. ..... 445/26

(58) Field of Classification Search ..... 445/24–26; 313/636

See application file for complete search history.

(56) References Cited

U.S. PATENT DOCUMENTS

| | | | | |
|---|---|---|---|---|
| 2002/0047611 | A1* | 4/2002 | Kaneko et al. | 315/246 |
| 2006/0035558 | A1 | 2/2006 | Hataoka et al. | |
| 2007/0052365 | A1 | 3/2007 | Sakaguchi et al. | |

FOREIGN PATENT DOCUMENTS

| | | |
|---|---|---|
| JP | 2005-005027 | 1/2005 |
| JP | 2007-048736 | 2/2007 |
| WO | WO 2004/086443 | 10/2004 |

OTHER PUBLICATIONS

International Search Report for Application Serial No. PCT/JP2009/060495 dated Sep. 8, 2009.

Notification of Transmittal of Translation of the International Preliminary Report on Patentability (Application No. PCT/JP2009/060495) dated Mar. 24, 2011.

* cited by examiner

*Primary Examiner* — Toan Ton
*Assistant Examiner* — Hana Featherly
(74) *Attorney, Agent, or Firm* — Eric J. Robinson; Robinson Intellectual Property Law Office, P.C.

(57) ABSTRACT

Provided is a manufacturing method to prevent devitrification of a bulb in a high pressure discharge lamp used for a projector. The method is for manufacturing a high pressure discharge lamp which uses, as a light source, a bulb made of fused quartz and including a tungsten electrode, and which is horizontally installed when the lamp is driven for actual use. The method includes the step of initially driving the bulb with an optical axis thereof being set horizontally before the high pressure discharge lamp is shipped. In the initial driving step, the rotation angle around the optical axis of the bulb is offset by 45° or more and 135° or less relative to the rotation angle around the optical axis of the bulb when the lamp is driven for actual use.

14 Claims, 5 Drawing Sheets

METHOD FOR MANUFACTURING HIGH PRESSURE DISCHARGE LAMP

TECHNICAL FIELD

The present invention relates to a method for manufacturing a high pressure discharge lamp. More specifically, the invention relates to a manufacturing method to prevent devitrification of a bulb in a high pressure discharge lamp used for a projector.

BACKGROUND ART

FIG. 1 illustrates a general method for manufacturing a high pressure discharge lamp for a projector.

In Step S100, a bulb is prepared. In this bulb preparation step, a light emitting part of the bulb made of fused quartz is filled with argon, halogen, mercury, or the like and sealed. Sealing parts are formed at both ends of the light emitting part. Electrodes made of tungsten are placed in the light emitting part, and molybdenum foils are attached to the electrodes. Moreover, if necessary, the sealing parts are engraved with a lot number by laser marking.

In Step S110, an initial driving is performed for several minutes to several hours. This initial driving step is intended for aging, screening, and the like.

In Step S120, a lead wire and, if necessary, a trigger wire are attached to the bulb.

In Step S130, the bulb is attached to a reflector. This attachment step includes a step of mounting the bulb onto the reflector, a step of positioning the bulb relative to the reflector, and a step of fixedly attaching the two. In the positioning step, generally an operation is performed in which the bulb in a driving state is positioned at an optimum position relative to the reflector.

In Step S140, when necessary, inspection driving is performed. Here, checked are: whether the illuminance and the like meet the specification, whether the optical axis is not shifted, and so forth.

After Step S140, a high pressure discharge lamp thus completed is incorporated into a projector main body in Step S200. Thus, a projector is completed.

As the usage mode of projectors, there are a desktop type and a ceiling type. As the ceiling type, a projector of the desktop type simply turned upside down can be used, and an image is merely inverted.

Conventionally, the use of the desktop type has been common. However, in the recent years, the ceiling type is increasingly used for education. For this reason, a projector has often been used in such a manner that the projector is turned upside down depending on the initial driving and the actual use driving.

In such a circumstance, we have repeatedly manufactured and tested prototypes. As a result, we have found that there is a difference in time when devitrification occurs in a lamp between the desktop type and the ceiling type. As a result of the analysis, devitrification is assumed to have a mechanism as follows.

Note that, in this description, "driving" means driving in the horizontal direction.

(1) A surface modified layer or a burr formed during preparation of an electrode of a bulb is left on the electrode surface.

(2) Within approximately several seconds after the start of an initial driving of the bulb, the burr or the like on the electrode surface is dispersed together with mercury in the bulb and adheres to an inner wall thereof.

(3) In an evaporation process of mercury with increase in the temperature of the bulb, a difference in temperature occurs between an upper portion and a lower portion of the bulb. Specifically, the temperature of the upper portion is high, while the temperature of the lower portion is low.

(4) Within approximately several tens of seconds after the start of the initial driving, mercury and a tungsten residue on a hotter upper portion of the inner wall are removed.

(5) Within approximately several tens of seconds after the start of the initial driving, the temperature of the entire bulb is increased, mercury on a lower portion of the inner wall also evaporates, but the tungsten residue is left unremoved.

(6) After the initial driving is completed, mercury adheres to the electrode and the vicinity thereof, while the tungsten residue left on the lower portion of the inner wall stays adhering to the lower portion of the inner wall.

(7) If the bulb is driven for actual use in the same direction as that in the initial driving, devitrification hardly occurs. Meanwhile, if the actual-use driving is performed with the bulb upside down, the originally lowermost portion on which the tungsten residue remains is then placed at an uppermost portion. As a result, this tungsten-residue-adhering portion is located at the highest-temperature position when a lamp is driven.

(8) Accordingly, devitrification occurs as pure quartz changes to cristobalite with the tungsten-residue-adhering portion serving as the core.

In normal use for the desktop type, the up-down direction coincides between the initial driving and the actual-use driving. The tungsten-adhering portion is located at the lower portion (low-temperature portion). Thus, the problem of devitrification rarely occurs.

However, the introduction of the ceiling type hinders the up-down direction for the actual use from being specified in the manufacturing of a high pressure discharge lamp or a projector for this type. For this reason, a measure to prevent devitrification is needed, even if a high pressure discharge lamp manufactured by a single manufacturing method is used for the desktop type or for the ceiling type.

As one method for dealing with this devitrification problem, for example, Patent Document 1 discloses a technique including an electronic ballast and a rotary motor. The motor rotates a bulb or a high pressure discharge lamp, if necessary (for example, the motor rotates the component by a predetermined angle for each event such as turning a light on or off). Thereby, a specific portion of the bulb is not fixed to an uppermost portion, that is, the highest-temperature portion.

In this manner, a portion to be the upper portion of the bulb is changed upon each event to avoid fixation of the tungsten-residue-adhering portion to the high-temperature portion. Thus, occurrence of devitrification is prevented.

Prior Art Document List

Patent Document

Patent Document 1: JP Patent Publication 2007-48736

SUMMARY OF THE INVENTION

Problems to be Solved by the Invention

However, the technique of Patent Document 1 has the following problems.

A first problem is the effect of preventing devitrification. It is questionable whether the effect of preventing devitrification is sufficiently obtained by, after a tungsten residue adheres to a specific spot during the initial driving, changing the position of the spot by the rotation during the actual driving. Particularly, it is expected that the occurrence of devitrification is rather promoted during a period when the tungsten-residue-adhering spot in the initial driving is located on the uppermost portion by rotation in the actual driving.

A second problem is in the actual usage mode. When the technique in the document is used, components such as the motor have to be installed in a projector. Installation of the motor and a driving unit therefor inevitably causes the cost, size and weight of the projector to increase. Particularly, in a case where the ceiling type is considered, the projector small in size and light in weight is desirable. The installation of the motor and so forth is in contrary to this demand.

A third problem is the versatility of the technique in this document. Even when the technique of this document is applied to a projector, no solution is offered to users who own an existing projector not equipped with the rotary motor.

A fourth problem is the safety and reliability of a product. The technique in the document adopts the configuration in which a power-receiving side (lamp) is rotated relative to a power-supplying side (electronic ballast). It is necessary to prevent wiring from being twisted by the rotation or to surely guarantee an electrical contact point. Accordingly, a problem occurs in guaranteeing the reliability of the wiring and contact point. Particularly, a high voltage pulse needs to be applied to a high pressure discharge lamp for the start-up. From the viewpoint of safety of the apparatus also, the configuration including rotation system (configuration in which the contact point or the wiring moves) should be avoided as much as possible.

Against this background, first of all, it is necessary to establish a method for surely preventing devitrification.

Then, a measure to prevent devitrification needs to be taken without increases in cost, size, and weight of the projector.

In addition, it is better to solve the devitrification problem by modification on a high pressure discharge lamp but not on a projector main body. This is because the devitrification problem of the ceiling type can be solved only by replacing an original lamp in an existing projector with a modified lamp.

Moreover, the safety and the reliability in driving a high pressure discharge lamp also have to be guaranteed.

Therefore, if measures are taken not "during the use" of a high pressure discharge lamp but "during the manufacturing," all the problems described above can be solved.

Means for Solving the Problems

The first aspect of the present invention is a method for manufacturing a high pressure discharge lamp which uses, as a light source, a bulb made of fused quartz and including a tungsten electrode, and which is installed horizontally when the lamp is driven for actual use, the manufacturing method including the steps of: (A) preparing the bulb; (B) initially driving the bulb; and (C) attaching the bulb to a reflector having a predetermined vertical axis for actual use, wherein the step (A) includes forming a first mark in a sealing part of the bulb, the step (B) comprises performing the driving while an optical axis of the bulb is set horizontally, and while the first mark is fixed at a position which is on a plane perpendicular to the optical axis and which is located in a lateral direction from the optical axis, wherein the lateral direction is at an angle of 45° or more and 135° or less with respect to the vertical direction, and the step (C) includes the step of (c1) mounting the bulb onto the reflector in a manner that the first mark is located on the vertical axis.

A second aspect of the present invention is a method for manufacturing a high pressure discharge lamp which uses, as a light source, a bulb made of fused quartz and including a tungsten electrode, and which is installed horizontally when the lamp is driven for actual use, the manufacturing method including the steps of: (A) preparing the bulb; (B) initially driving the bulb; and (C) attaching the bulb to a reflector having a predetermined horizontal axis for actual use, wherein the step (A) includes forming a first mark in a sealing part of the bulb, the step (B) comprises performing the driving while an optical axis of the bulb is set horizontally, and while the first mark is fixed at a position which is on a plane perpendicular to the optical axis and which is located in an up-down direction from the optical axis, wherein the up-down direction is at an angle of ±45° with respect to the vertical direction, and the step (C) includes the step of (c1) mounting the bulb onto the reflector in a manner that the first mark is located on the horizontal axis.

In any one of the first and second aspects, any one of the horizontal axis and the vertical axis for actual use of the reflector may be indicated by a second mark, and the step (c1) may comprise mounting the bulb onto the reflector in a manner that the first mark and the second mark are located on a single plane including the optical axis.

In any one of the first and second aspects, the step (C) may further include the steps of: (c2) driving the bulb while the optical axis is kept horizontally, and a direction of the first mark relative to the optical axis is fixed to be the same as that in the step (B), thus positioning the bulb relative to the reflector; and (c3) fixedly attaching the bulb to the reflector.

Moreover, after the step (C), the method may further include the step of (D) inspection driving the bulb while the optical axis is kept horizontally, and a direction of the first mark relative to the optical axis is fixed to be the same as that in the step (B).

In any one of the first and second aspects, the first mark may be a printed letter by laser marking, or the first mark may be a lot mark, as a matter of course.

A third aspect of the present invention is a method for manufacturing a high pressure discharge lamp which uses, as a light source, a bulb made of fused quartz and including a tungsten electrode, and which is installed horizontally when the lamp is driven for actual use, the manufacturing including: the step of initially driving the bulb with an optical axis of the bulb being set horizontally before the high pressure discharge lamp is shipped. In the manufacturing method, a rotation angle around the optical axis of the bulb in the initial driving step is offset by an angle of 45° or more and 135° or less, preferably offset by a right angle, relative to a rotation angle around the optical axis of the bulb in an actual-use driving.

Moreover, the method may further include the step of, before the initially driving step, providing a lot mark in a sealing part of the bulb, and the rotation angle around the optical axis of the bulb may be determined by using a position of the lot mark.

MODES FOR CARRYING OUT THE INVENTION

<Basic Concept of the Present Invention>

Figure 2A:
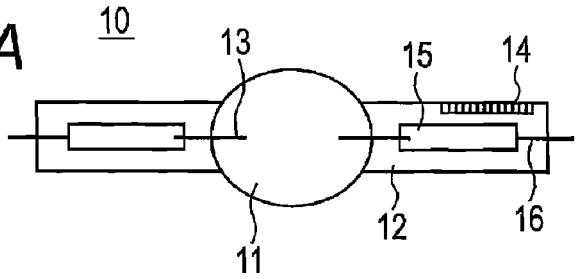
FIG. 2A is a drawing for explaining the present invention.

As shown in FIG. 2A, a bulb 10 is formed of a light emitting part 11 made of quartz and a sealing part 12. A metal foil 15 made of molybdenum is hermetically buried in the sealing part 12 with shrink sealing, for example. A shaft portion of an electrode 13 made of tungsten is bonded to one end of the metal foil 15, while an external molybdenum lead 16 is bonded to the other end of the metal foil 15 to allow power to be fed from the outside. A lot mark 14 will be described later.

Figure 2B:
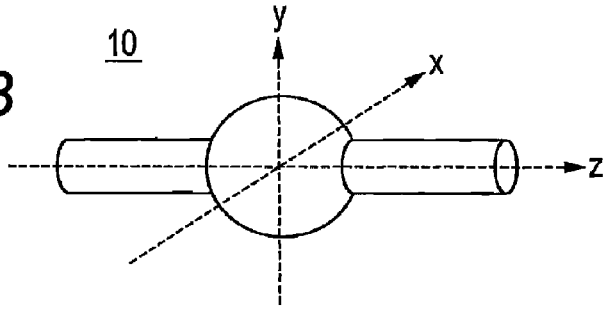
FIG. 2B is a drawing for explaining the present invention.

Note that, for convenience of description, as shown in FIG. 2B, an optical axis direction of the bulb 10 is designated as a z axis, and a horizontal direction and a vertical direction on a plane perpendicular to the z axis are respectively designated as an x axis and a y axis.

Figure 3A:
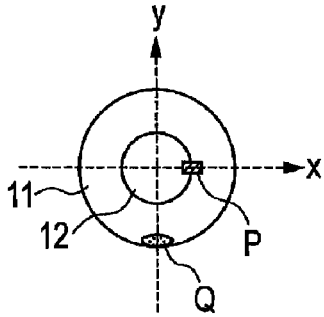
FIG. 3A is a drawing for explaining embodiments of the present invention.
Figure 3B:
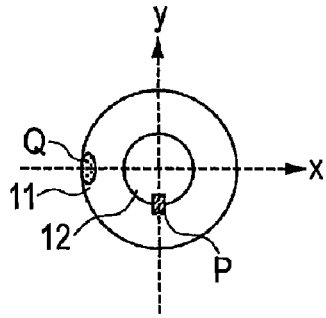
FIG. 3B is a drawing for explaining the embodiments of the present invention.
Figure 3C:
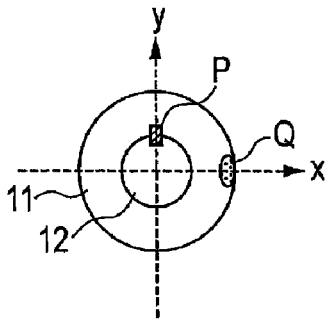
FIG. 3C is a drawing for explaining the embodiments of the present invention.

FIGS. 3A to 3C are drawings for explaining the basic concept of the present invention. In the present invention, it is assumed that, in an actual-use driving, the optical axis of the bulb 10 is set nearly horizontally. Meanwhile, in an initial driving, the optical axis of the bulb 10 is set horizontally, and the driving is performed with the rotation angle (orientation) of the bulb 10 around the z axis being made different from the rotation angle (orientation) around the z axis in the actual-use driving by 90°. Note that, in the following description, described will be the most preferable example where the angle to be offset is 90°. However, as long as the angle is 45° or more and 135° or less, advantages of the present invention are obtained.

Specifically, suppose that a mark specifying the rotation angle around the z axis in the x-y plane (hereinafter, referred to as a "P point") is on the bulb. Additionally, assume that, when the bulb 10 is placed in a projector, the P point is located as shown in FIG. 3B in a negative direction of the y axis (lowermost portion) for use in the desktop type, while the P point is located as shown in FIG. 3C in a positive direction of the y axis (uppermost portion) for use in the ceiling type. In the initial driving, the P point is located as shown in FIG. 3A in the x axis direction.

Similarly, assuming that (although unillustrated) that, for either the desktop type or the ceiling type, the P point is located in the x axis direction, the P point may be located in the y axis direction in the initial driving.

Here, in the initial driving in FIG. 3A, a tungsten residue remains in the vicinity of a portion in the negative direction of the y axis (i.e., on the lowermost portion) as described previously. In the following description, the point where this tungsten residue adheres is referred to as a Q point. In the actual-use driving, the Q point is located in the x axis direction for both the desktop type (FIG. 3B) and the ceiling type (FIG. 3C).

Thus, the Q point where tungsten adheres never comes to the uppermost portion in any of the desktop type and the ceiling type. Accordingly, it is possible to prevent devitrification from occurring in an initial stage. Furthermore, the following experiment revealed that devitrification never occurred earlier for use in any of the desktop type and the ceiling type, compared with the use in a conventional desktop type.

Table 1 shows the experimental result comparing the present invention with a conventional example. Note again that the Q point means a point in the vicinity of a portion where a tungsten residue adheres in the initial driving.

TABLE 1

| Sample No. | Lamp Power | Manufacturing method | Position of Q point: During SRC | Position of Q point: During life | Tested driving position | Hours (h) elapsed in life and degree of devitrification: 0 | 100 | 500 | 1000 | 1500 | 3000 |
|---|---|---|---|---|---|---|---|---|---|---|---|
| 01 | 200 W | Present | Negative | Positive | Desktop | None | None | None | None | None | Small |
| 02 | 150 W | Invention | in y axis | in x axis | | None | None | None | None | Small | Intermediate |
| 03 | 200 W | | (lowermost | Negative | Ceiling | None | None | None | None | Small | Small |
| 04 | 150 W | | portion) | in x axis | | None | None | None | None | None | Small |
| 11 | 200 W | Conventional | | Negative | Desktop | None | None | None | None | Small | Small |
| 12 | 150 W | | | in y axis | | None | None | None | None | None | None |
| 13 | 200 W | | | Positive in y axis | Ceiling | None | Minor | Minor | Small | Intermediate | Large (with deformation |
| 14 | 150 W | | | | | None | Minor | Minor | Small | Intermediate | Large |

Samples No. 01 to 04 are samples manufactured according to the method of the present invention, and Samples No. 11 to 14 are samples manufactured according to the conventional method. In any of the samples, the Q point is formed in the negative direction of the y axis (on the lowermost portion) during the initial driving as mentioned above.

Samples No. 01 and 02/No. 03 and 04 are assumed to have the position of the Q point being located in the positive direction/negative direction of the x axis during a life test, and to be used for the desktop type/ceiling type. Nevertheless, there is substantially no significant difference in the driving condition between the two.

Samples No. 11 and 12 are assumed to have the position of the Q point being located in the negative (lower) direction of the y axis during the life test, and to be used for the desktop type.

Samples No. 13 and 14 are assumed to have the position of the Q point being located in the positive (upper) direction of the y axis during the life test, and to be used for the ceiling type.

As seen from Table 1, in No. 13 and 14 manufactured according to the conventional method and assumed to be for the ceiling type, devitrification occurred already after 100 hours elapsed. After 3000 hours elapsed, the samples were no longer usable due to the progress of devitrification and deformation.

Meanwhile, in No. 01 to 04 manufactured according to the method of the present invention, for both the desktop and ceiling types, devitrification occurred to substantially the same degree as No. 11 and 12 manufactured according to the conventional method and assumed to be for the desktop type.

Thus, according to the manufacturing method of the present invention, the advantages of preventing devitrification are obtained regardless of use in the desktop or the ceiling type. What is important here is that the degree of devitrification occurred in the present invention is not an intermediate value between the degree of devitrification occurred in use in the desktop type and the degree of devitrification occurred in use in the ceiling type, but is at an equivalent level to use in the desktop type that has been conventionally considered favorable. In other words, devitrification-preventing effects are also obtained for the ceiling type without impairing the favorable properties for the desktop type that has been conventionally considered favorable.

What is additionally important is that the devitrification-preventing effects during the actual driving is achieved not by a measure taken during the actual driving as in Patent Document 1, but by a measure taken merely on, for example, the step during the initial driving in the manufacturing. Thereby, the versatility for supplying the high pressure discharge lamp to various projectors can be guaranteed. Moreover, in the initial driving during which no cooling is performed in the same way as in the inside of a projector, a large tensile strain tends to remain in the positive direction of the y axis on a rounded portion of fused quartz. The large strain at an uppermost portion (highest-temperature portion) is likely to induce a crack or rupturing in the continuous usage. By rotating this portion by 90°, the portion with the larger strain is not located at the uppermost portion (highest-temperature portion). Thus, an effect against rupturing is also exhibited.

As described above, the manufacturing method of the present invention makes it possible to effectively prevent devitrification for both the desktop and the ceiling types by merely devising the manufacturing method. Embodiments will be illustrated below.

Embodiment 1

Figure 1:
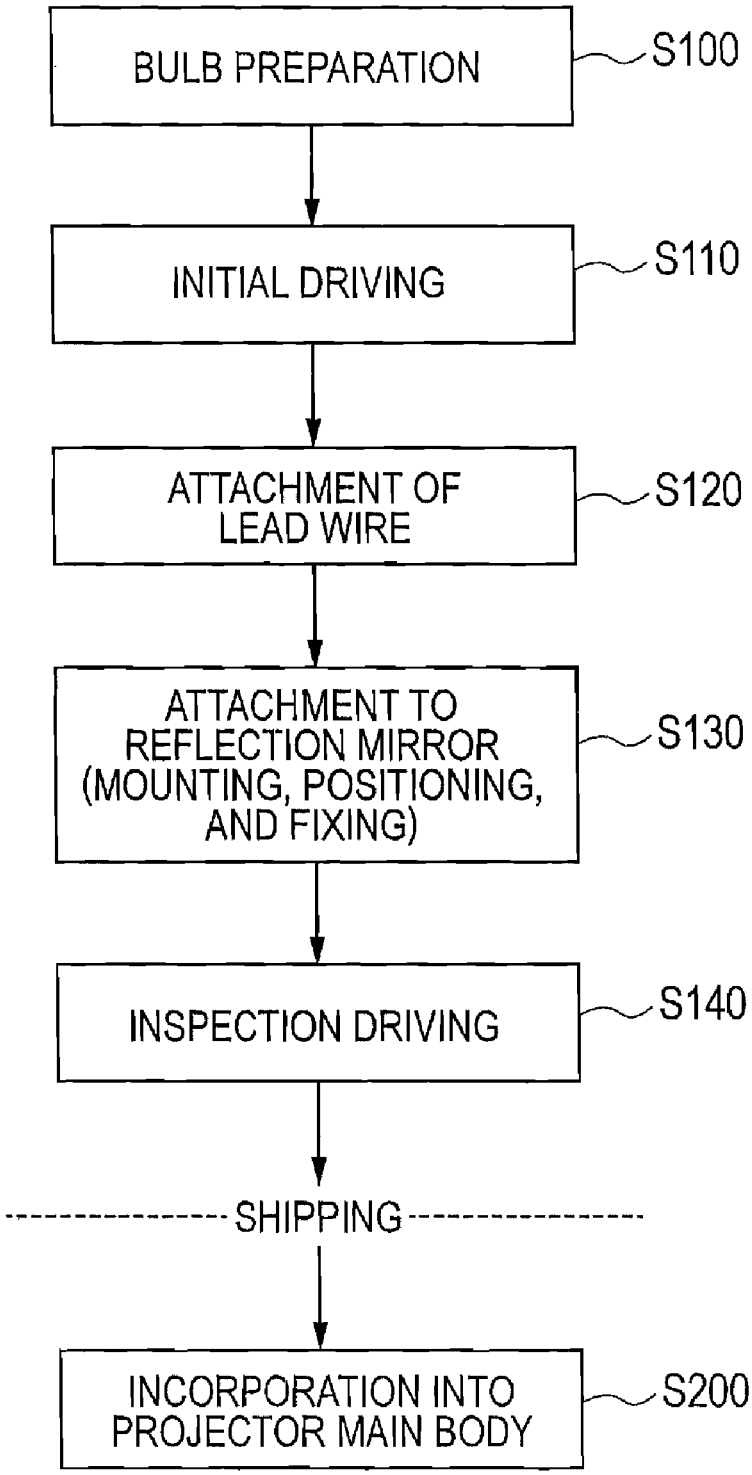
FIG. 1 is a diagram illustrating a general method for manufacturing a high pressure discharge lamp.

A first embodiment will be described with reference to FIGS. 4A to 4E. Note that, since the basic steps are the same as those in FIG. 1 described previously, overlapping description will be omitted.

In the bulb preparation step of Step S100, the sealing part 12 is engraved with the lot mark 14 by laser marking. By using the lot mark 14 as the mark for the P point, the P point can be specified without requiring an additional element (additional engraving or additional step).

Figure 4A:
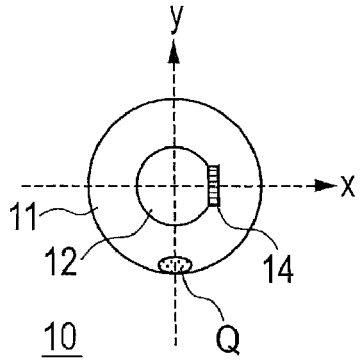
FIG. 4A is a drawing for explaining a manufacturing method according to a first embodiment of the present invention.

In the initial driving step of Step S110, as shown in FIG. 4A, the driving is performed in a manner that the lot mark 14 is located in the x axis direction. Here, a tungsten residue adheres to a portion in the negative direction of the y axis (the lowermost portion), and thus the Q point is determined. Thereby, the lot mark 14 (the P point) and the tungsten-adhering portion (the Q point) are located at a right angle to the optical axis (the z axis).

Note that, in the subsequent description, a driving with the P point located in the negative direction of the y axis is referred to as a "0° driving," a driving with the P point located in the x axis (either positive or negative) direction is referred to as a "90° driving," and a driving with the P point located in the positive direction of the y axis is referred to as a "180° driving." Accordingly, the 90° driving is performed in Step S110, and the 0° driving or 180° driving is performed in the actual-use driving.

Figure 4B:
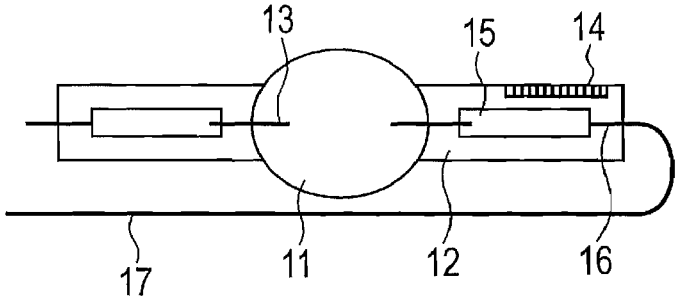
FIG. 4B is a drawing for explaining the manufacturing method according to the first embodiment of the present invention.

In Step S120, as shown in FIG. 4B, a lead wire 17 and, if necessary, a trigger wire (unillustrated) is attached to the Mo lead wire 16. Note that this step can be performed before Step S110.

Figure 4C:
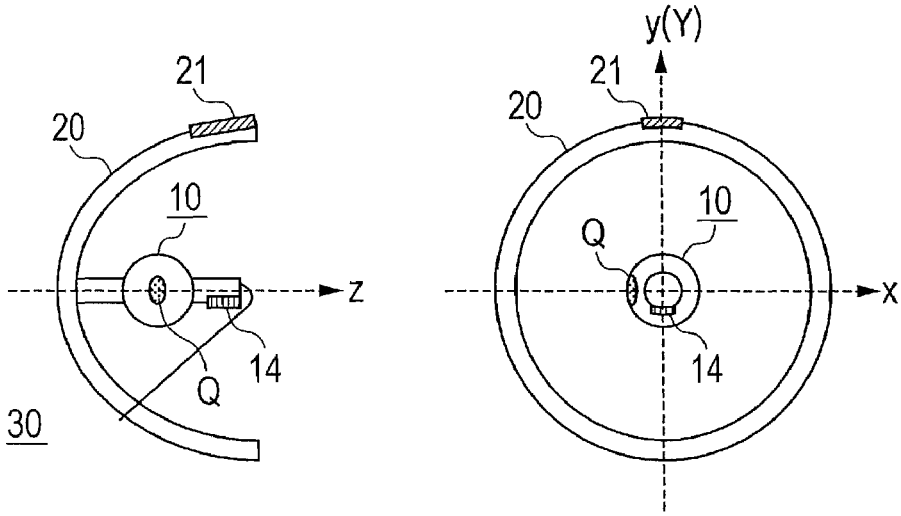
FIG. 4C is a drawing for explaining the manufacturing method according to the first embodiment of the present invention.
Figure 4D:
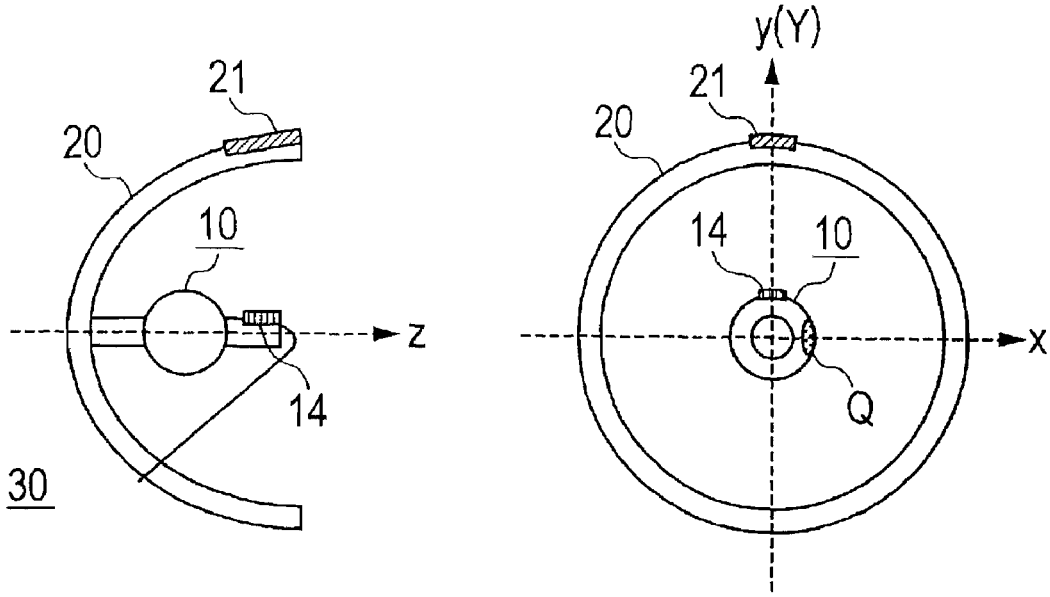
FIG. 4D is a drawing for explaining the manufacturing method according to the first embodiment of the present invention.

In the attachment step of Step S130, a reflector 20 has a predetermined vertical axis Y for actual use (i.e., when the mirror 20 is incorporated in a projector). For example, a TOP mark 21 indicating the uppermost portion during the usage in the desktop type is provided as shown in FIG. 4C or 4D, thereby indicating the vertical axis Y. Note that, such a mark as the TOP mark is a mark present on a reflector of an ordinary high pressure discharge lamp.

In the step of mounting the bulb onto the reflector, the bulb 10 is mounted onto the reflector 20 in a manner that the lot mark 14 is located on the vertical axis Y. In other words, the bulb 10 is mounted onto the reflector 20 in a manner that the optical axis, the lot mark 14 and the TOP mark 21 are located on a straight line when seen in the x-y plane. Moreover, in a three dimension, the lot mark 14 and the TOP mark 21 are located on a single plane including the optical axis.

At this point, the Q point of the tungsten-adhering portion is located in the horizontal direction (x axis direction).

Incidentally, the TOP mark 21 may be a printed letter, a label, a mark having a feature in shape, or the like. It goes without saying that, instead of the TOP mark, for example, a mark indicating the lowermost portion may be used, and the positional relation with the lot mark 14 should be determined as appropriate.

Alternatively, even if an explicit mark such as the TOP mark is not provided, as long as a configuration is provided which is capable of specifying the vertical axis Y of the reflector 20 when a high pressure discharge lamp 30 is attached to a projector main body 40, an engraving direction of the lot mark 14 can be determined based on that configuration.

In the positioning step of Step S130 and the inspection driving step of Step S140, the driving direction may be any of the 0° driving, the 90° driving, and the 180° driving. Here also, by adopting the 90° driving, the advantages of the present invention can be further expected.

However, the driving periods in the positioning step and in the inspection step are each approximately 5 minutes, which is shorter than the driving period (2 to 3 hours) of the initial driving step of Step S110. Accordingly, the driving periods in these steps are not dominant. Thus, in Steps S130 and S140, a driving direction suitable for manufacturing should be selected as appropriate.

The high pressure discharge lamp 30 is completed through Steps S130 and S140, and shipped.

Figure 4E:
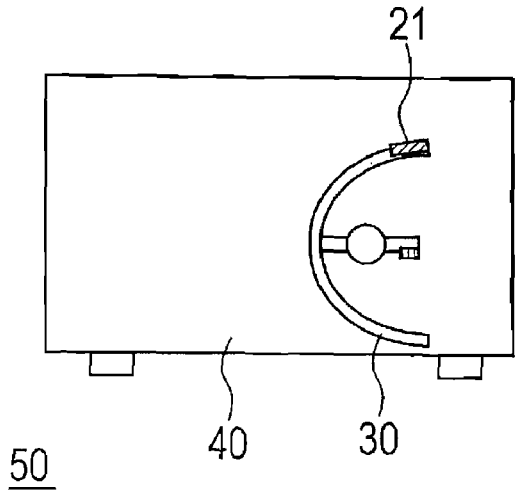
FIG. 4E is a drawing for explaining the manufacturing method according to the first embodiment of the present invention.

In Step S200 after the shipping, as shown in FIG. 4E, the high pressure discharge lamp 30 is incorporated into the projector main body 40 in a predetermined up-down direction in accordance with the TOP mark 21. Thus, a projector 50 is completed. A desktop mounted state is shown in FIG. 4E, whereas a ceiling mounted state is the reverse of the desktop mounted state in the up-down direction. Note that Step S200 is a step ordinarily performed when projectors are manufactured.

Thus, whichever the projector is used as the desktop type or the ceiling type, the tungsten-residue-adhering spot (Q point) is always located in the x axis direction, and is accordingly never located on the uppermost portion (the highest-temperature portion). Devitrification can be prevented in both cases of desktop type and ceiling type.

Embodiment 2

A second embodiment will be described with reference to FIGS. 5A to 5D. Note that, since the basic steps are the same as those in FIG. 1 described previously, overlapping description will be omitted.

Moreover, the bulb preparation step of Step S110 is the same as that in Embodiment 1.

Figure 5A:
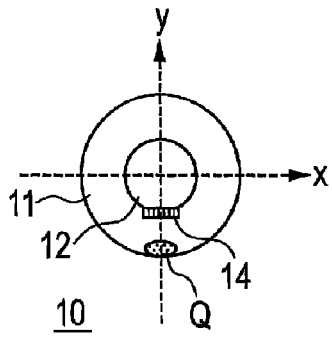
FIG. 5A is a drawing for explaining a manufacturing method according to a second embodiment of the present invention.
Figure 5B:
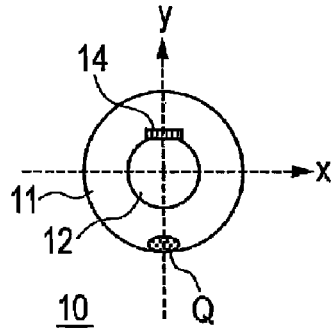
FIG. 5B is a drawing for explaining the manufacturing method according to the second embodiment of the present invention.

In the initial driving step of Step S110, as shown in FIG. 5A or 5B, the driving is performed in a manner that the lot mark 14 is located in the y axis direction. Here, a tungsten residue adheres to a portion in the negative direction of the y axis (the lowermost portion), and thus the Q point is determined. Thereby, the lot mark 14 (the P point) and the tungsten-adhering portion (the Q point) are located on the same side or on sides opposite from each other with respect to the optical axis (the z axis).

Note that, as in Embodiment 1, a driving with the P point located in the negative direction of the y axis is referred to as a "0° driving," a driving with the P point located in the x axis (either positive or negative) direction is referred to as a "90° driving," and a driving with the P point located in the positive direction of the y axis is referred to as a "180° driving." Accordingly, the 0° driving or the 180° driving is performed in Step S110, and the 90° driving is performed in the actual-use driving.

In Step S120, as in FIG. 4B of Embodiment 1, the lead wire 17 and, if necessary, the trigger wire (unillustrated) is attached to the Mo lead wire 16. Note that this step can be performed before Step S110.

Figure 5C:
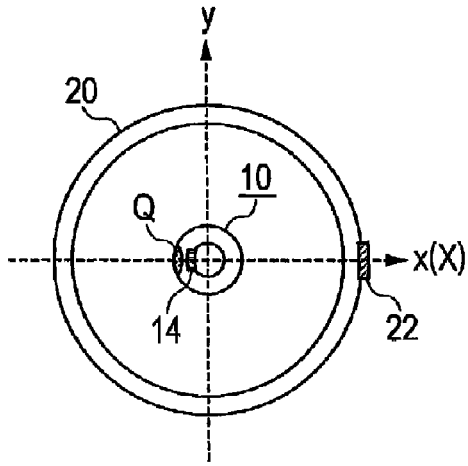
FIG. 5C is a drawing for explaining the manufacturing method according to the second embodiment of the present invention.
Figure 5D:
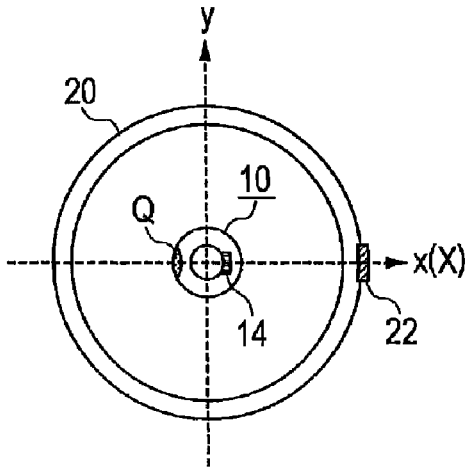
FIG. 5D is a drawing for explaining the manufacturing method according to the second embodiment of the present invention.

In the attachment step of Step S130, the reflector 20 has a predetermined horizontal axis X for actual use (i.e., when the mirror 20 is incorporated in a projector). For example, a SIDE mark 22 is provided in a side portion as shown in FIG. 5C or 5D, thereby indicating the horizontal axis X.

In the step of mounting the bulb onto the reflector, the bulb 10 is mounted onto the reflector 20 in a manner that the lot mark 14 is located on the horizontal axis X. In other words, the bulb 10 is mounted onto the reflector 20 in a manner that the optical axis, the lot mark 14 and the SIDE mark 22 are located on a straight line when seen in the x-y plane. Moreover, in a three dimension, the lot mark 14 and the SIDE mark 22 are located on a single plane including the optical axis.

At this point, the Q point of the tungsten-adhering portion is located in the horizontal direction (x axis direction).

Incidentally, as similar to the TOP mark 21, the SIDE mark 22 may be a printed letter, a label, a mark having a feature in shape, or the like.

Alternatively, even if an explicit mark such as the SIDE mark is not provided, as long as a configuration is provided which is capable of specifying the horizontal axis X of the reflector 20 when a high pressure discharge lamp 30 is attached to a projector main body 40, an engraving direction of the lot mark 14 can be determined based on that configuration.

In the positioning of the lamp when the lamp is incorporated into the projector in Step S130 and in the inspection driving step of Step S140, the driving direction may be any of the 0° driving, the 90° driving, and the 180° driving. Here also, by adopting the 0° driving or the 180° driving, the advantages of the present invention can be further expected.

However, the driving periods in Steps S130 and S140 are each approximately 5 minutes, which is shorter than the driving period (2 to 3 hours) of the initial driving step of Step S110. Accordingly, the driving periods in these steps are not dominant. Thus, in Steps S130 and S140, a driving direction suitable for manufacturing should be selected as appropriate.

The high pressure discharge lamp 30 is completed through Steps S130 and S140, and shipped.

In Step S200 after the shipping, the high pressure discharge lamp 30 is incorporated into the projector main body 40 in a predetermined direction in accordance with the SIDE mark 22. Thus, a projector 50 is completed.

Thus, also in the present embodiment, whichever the projector is used as the desktop type or the ceiling type, the tungsten-residue-adhering spot (Q point) is always located in the x axis direction, and is accordingly never located on the uppermost portion (the highest-temperature portion). Devitrification can be prevented in both cases of desktop type and ceiling type.

<Other Modified Embodiments>

In the above-described embodiments, the mark indicating the P point is the lot mark 14 formed by laser marking, which is the most preferable example; however, marks in other forms may be provided. For example, the sealing part 12 may be provided with a mark having a feature in shape such as a projected portion or a recessed portion to determine the P point. A label or the like may be pasted on the sealing part 12. Alternatively, the x-y sectional shape of the sealing part 12 may be formed into a shape having width and height different from each other, such as into an ellipse for example, thereby allowing the 90° rotation around the optical axis (z axis) to be recognizable.

In the embodiments, the lot mark 14 is located in the x axis (or y axis) direction in the initial driving, and located in the y axis (or x axis) direction in the actual-use driving. However, as long as the lot mark 14 is rotated by approximately 90° around the optical axis (z axis) between the initial driving and the actual-use driving, it is meaningless to persist in the xy coordinates.

In the embodiments, the "90° driving" is illustrated as the most preferable example. However, the advantages of the present invention are obtained if the angle of "90°" or "right angle" is changed to an "angle of 45° or more and 135° or less."

In the embodiments, in the illustrated example, the 90° driving is performed in any of the steps before shipping, and then the shipping is performed with the 0° driving state being established. However, as the 90° driving state being established at the time of shipping, the 0° driving may be established in the later step of incorporating the lamp into the projector (S200).

In the embodiments, in the step of positioning the lamp when the lamp is incorporated into the projector in Step S130, the bulb 10 is positioned while being driven. However, the bulb 10 may be positioned while not being driven provided that the matching properties in shape of the bulb 10 and the reflector 20 and the accuracy of a positioning jig are high. In this case, the driving angle around the z axis in Step S130 may be at any angle as a natural consequence.

According to the present invention, the present invention has a configuration in which a spot where tungsten adheres by the initial driving is never located in the uppermost portion during the actual use. Thus, the advantages of preventing devitrification are surely obtained.

Moreover, devitrification can be prevented without increases in cost, size, and weight of the projector.

Furthermore, the devitrification problem is solved not by modification of the projector main body, but by modification of the high pressure discharge lamp. Accordingly, only by replacing an original lamp in an existing projector with the modified lamp, the devitrification problem of the ceiling type can be solved.

Still furthermore, the present invention does not include a constituent for rotating the high pressure discharge lamp. Accordingly, the safety and reliability of driving the high pressure discharge lamp can also be guaranteed as in a conventional product.

EXPLANATION OF REFERENCE NUMERALS

10. bulb
11. light emitting part
12. sealing part
13. electrode
14. lot mark
15. molybdenum foil
16. molybdenum lead wire
17. lead wire
20. reflector
21. TOP mark
22. SIDE mark
30. high pressure discharge lamp
40. main body
50. projector

The invention claimed is:

1. A method for manufacturing a high pressure discharge lamp which uses, as a light source, a bulb made of fused quartz and including a tungsten electrode, and which is installed horizontally when the lamp is driven for actual use, the manufacturing method comprising the steps of:

(A) preparing the bulb;

(B) initially driving the bulb so that a tungsten residue adheres to a lowermost portion in the bulb; and (C) attaching the bulb to a reflector having a predetermined vertical axis for actual use, wherein the step (A) includes forming a first mark in a sealing part of the bulb, the step (B) comprises performing the driving while an optical axis of the bulb is set horizontally, and while the first mark is fixed at a position which is on a plane perpendicular to the optical axis and which is located in a lateral direction from the optical axis, wherein the lateral direction is at an angle of 45° or more and 135° or less with respect to the vertical direction, and the step (C) includes the step of (c1) mounting the bulb onto the reflector in a manner that the first mark is located on the vertical axis in order that the tungsten residue adhered by the step (B) is located in the lateral direction.

2. The manufacturing method according to claim 1, wherein any one of the horizontal axis and the vertical axis for actual use of the reflector is indicated by a second mark, and the step (c1) comprises mounting the bulb onto the reflector in a manner that the first mark and the second mark are located on a single plane including the optical axis.

3. The manufacturing method according to claim 1, in addition, wherein the step (C) further includes the steps of:

(c2) driving the bulb while the optical axis is kept horizontally, and a direction of the first mark relative to the optical axis is fixed to be the same as that in the step (B), thus positioning the bulb relative to the reflector; and (c3) fixedly attaching the bulb to the reflector.

4. The manufacturing method according to claim 1, further comprising the step of, after the step (C):

(D) inspection driving the bulb while the optical axis is kept horizontally, and a direction of the first mark relative to the optical axis is fixed to be the same as that in the step (B).

5. The manufacturing method according to, claim 1 wherein the first mark is a printed letter by laser marking.

6. The manufacturing method according to, claim 1, wherein the first mark is a lot mark.

7. A method for manufacturing a high pressure discharge lamp which uses, as a light source, a bulb made of fused quartz and including a tungsten electrode, and which is installed horizontally when the lamp is driven for actual use, the manufacturing method comprising the steps of:

(A) preparing the bulb;

(B) initially driving the bulb so that a tungsten residue adheres to a lowermost portion in the bulb; and (C) attaching the bulb to a reflector having a predetermined horizontal axis for actual use, wherein the step (A) includes forming a first mark in a sealing part of the bulb, the step (B) comprises performing the driving while an optical axis of the bulb is set horizontally, and while the first mark is fixed at a position which is on a plane perpendicular to the optical axis and which is located in an up-down direction from the optical axis, wherein the up-down direction is at an angle of ±45° with respect to the vertical direction, and the step (C) includes the step of (c1) mounting the bulb onto the reflector in a manner that the first mark is located on the horizontal axis in order that the tungsten residue adhered by the step (B) is not located in the up-down direction.

8. The manufacturing method according to claim 7, wherein any one of the horizontal axis and the vertical axis for actual use of the reflector is indicated by a second mark, and the step (c1) comprises mounting the bulb onto the reflector in a manner that the first mark and the second mark are located on a single plane including the optical axis.

9. The manufacturing method according to claim 7, in addition, wherein the step (C) further includes the steps of:

(c2) driving the bulb while the optical axis is kept horizontally, and a direction of the first mark relative to the optical axis is fixed to be the same as that in the step (B), thus positioning the bulb relative to the reflector; and (c3) fixedly attaching the bulb to the reflector.

10. The manufacturing method according to claim 7, further comprising the step of, after the step (C):

(D) inspection driving the bulb while the optical axis is kept horizontally, and a direction of the first mark relative to the optical axis is fixed to be the same as that in the step (B).

11. The manufacturing method according to claim 7, wherein the first mark is a printed letter by laser marking.

12. The manufacturing method according to claim 7, wherein the first mark is a lot mark.

13. A method for manufacturing a high pressure discharge lamp which uses, as a light source, a bulb made of fused quartz and including a tungsten electrode, and which is installed horizontally when the lamp is driven for actual use, the manufacturing method characterized by comprising the step of:

initially driving the bulb with an optical axis of the bulb being set horizontally so that a tungsten residue adheres to a lowermost portion in the bulb, before the high pressure discharge lamp is shipped, wherein a rotation angle around the optical axis of the bulb in the initial driving step is offset by an angle of 45° or more and 135° or less relative to a rotation angle around the optical axis of the bulb in an actual-use driving, so that the tungsten residue adhered by the step of initially driving is located in a side portion of the bulb.

14. The manufacturing method according to claim 13, further comprising the step of, before the initially driving step, providing a lot mark in a sealing part of the bulb, wherein the rotation angle around the optical axis of the bulb is determined by using a position of the lot mark.

* * * * *